US009374633B2

(12) United States Patent
Adams et al.

(10) Patent No.: US 9,374,633 B2
(45) **Date of Patent: *Jun. 21, 2016**

(54) AUDIO AMPLIFIER ATTACHABLE TO SPEAKER SYSTEM BY WAY OF MAGNETIC COUPLER AND METHOD THEREFOR

(75) Inventors: Charles C. Adams, Gilbert, AZ (US); Dale Vernon Curtis, Scottsdale, AZ (US); Jerry Kenneth Hubbard, Chandler, AZ (US); Eric Matthew Miller, Phoenix, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 1249 days.

This patent is subject to a terminal disclaimer.

(21) Appl. No.: 12/877,931

(22) Filed: Sep. 8, 2010

(65) Prior Publication Data

US 2010/0329484 A1 Dec. 30, 2010

Related U.S. Application Data

(63) Continuation of application No. 11/018,010, filed on Dec. 20, 2004, now Pat. No. 7,804,966.

(51) Int. Cl.
*H04R 1/02* (2006.01)
*H04R 1/06* (2006.01)

(52) U.S. Cl.
CPC .. *H04R 1/02* (2013.01); *H04R 1/06* (2013.01); *H04R 2420/03* (2013.01)

(58) Field of Classification Search
CPC ..... H04R 5/02; H04R 1/025; H04R 1/026
USPC ..... 381/171, 176–177, 396, 412, 419–420, 381/87, 386, 382, 336, 150, 334; 181/145, 181/148, 150, 30; 84/725, 723, 327
See application file for complete search history.

(56) References Cited

U.S. PATENT DOCUMENTS

| | | | | |
|---|---|---|---|---|
| 4,843,624 | A | 6/1989 | Rashak | |
| 5,852,545 | A * | 12/1998 | Pan-Ratzlaff | 361/679.23 |
| 5,900,715 | A * | 5/1999 | Roberts | H01M 10/46 320/115 |
| 6,357,887 | B1 | 3/2002 | Novak | |
| 6,561,815 | B1 * | 5/2003 | Schmidt | 439/38 |
| 6,640,924 | B2 * | 11/2003 | Messner | H04R 1/026 181/144 |
| 7,256,342 | B2 * | 8/2007 | Hagiwara | G10H 3/146 84/411 R |
| 7,328,769 | B1 * | 2/2008 | Adamson | H04R 1/026 181/144 |
| 2002/0153195 | A1 * | 10/2002 | Messner | H04R 1/026 181/198 |

* cited by examiner

*Primary Examiner* — Disler Paul
(74) *Attorney, Agent, or Firm* — Robert D. Atkins; Patent Law Group: Atkins and Associates, P.C.

(57) ABSTRACT

An audio system comprises a first enclosure for housing a first audio component and a second enclosure for housing a second audio component. The first enclosure includes a surface having a plurality of first structures, the first structures comprising one selected from a group consisting of a plurality of protrusions and a plurality of receptacles. The second enclosure includes a surface having a plurality of second structures, the second structures comprising the other one from the group consisting of the plurality of protrusions and the plurality of receptacles. The protrusions are configured to be inserted into the receptacles along a first direction such that the first enclosure is maintained in a first position relative to the second enclosure in the presence of a shear force that is applied in a direction that is perpendicular to the first direction.

19 Claims, 5 Drawing Sheets

AUDIO AMPLIFIER ATTACHABLE TO SPEAKER SYSTEM BY WAY OF MAGNETIC COUPLER AND METHOD THEREFOR

CLAIM TO DOMESTIC PRIORITY

The present application is a continuation of U.S. patent application Ser. No. 11/018,010, filed Dec. 20, 2004, and claims priority to this application pursuant to 35 U.S.C. §120.

FIELD OF THE INVENTION

The present invention relates in general to audio sound systems and, more particularly, to an audio amplifier attachable to a speaker system by way of a magnetic coupler.

BACKGROUND OF THE INVENTION

Audio amplifiers and speakers for entertainment systems can take a variety of forms. In one case, musical instruments generate electrical audio signals representative of sounds produced by the instrument. Electric guitars and electric bass guitars are well-known musical instruments. The artist plays the guitar and generates electric signals representative of the intended notes and chords. In another case, the audio signals may be generated from vocals through a microphone. The electrical signals are routed through one or more audio amplifiers for pre-amplification, power amplification, filtering, and other signal processing to enhance the tonal quality and properties of the signal. The processed signals then drive a speaker system to generate or reproduce the original sound from the musical instrument for the audience.

The audio amplifier and speaker system may be arranged in one integrated unit, or may be housed in separate units or enclosures. Higher-end systems generally have separate audio amplifier and speakers components. When the user sets up the audio amplifier and speaker system, the individual units are placed in proximity to one another and then electrically connected. The speaker may be placed on the floor and the audio amplifier may be placed on a table. If no other sturdy platform or surface is available, the audio amplifier can be stacked or placed on top of the speaker. The musical instrument is plugged into the audio input jack of the amplifier, and the audio output of the amplifier is electrically connected to the speaker with external cabling. The instrument and speaker cabling may be long and is usually draped over objects or laid on the floor.

In cases where the audio amplifier is stacked on the top surface of the speaker, there is generally little or no securing mechanism between the components. The audio amplifier remains in place primarily due to the effects of gravity and any lip or edge around the top of the speaker. The top of the speaker may have a non-skid surface, but there is little less holding the audio amplifier in place.

In the event that the stacked audio amplifier and speaker units are bumped, the audio amplifier can be knocked off the speaker. If the electrical cable between the musical instrument and audio amplifier is pulled, e.g., someone trips over the cable or the artist wanders too far from the amplifier while carrying the instrument, then the audio amplifier can be pulled off the speaker. Since the speaker is generally a heavier component, the audio amplifier will dislodge and fall off before the speaker moves or tips over. The audio amplifier may be damaged if it strikes the floor with sufficient force.

A need exists to secure the audio amplifier to the speaker when the components are stacked.

SUMMARY OF THE INVENTION

In one embodiment, the present invention is a first audio component having a surface with a plurality of feet disposed thereon, and a second audio component electrically coupled to the first audio component and having a surface with a plurality of receptacles disposed thereon. The feet protrude from the surface of the first audio component, and the receptacles extend below the surface of the second audio component. The feet of the first audio component are configured to be inserted into the receptacles of the second audio component along a first direction such that the first audio component is maintained in a first position relative to the second audio component in the presence of a shear force that is applied to the first audio component or the second audio component in a direction that is perpendicular to the first direction.

In another embodiment, the present invention is an audio system comprising a first audio component having a surface with a protrusion disposed thereon, and a second audio component having a surface with a receptacle disposed thereon. The protrusion extends above the surface of the first audio component, and the receptacle extends below the surface of the second audio component. The protrusion is configured to be inserted into the receptacle along a first direction such that the first audio component is maintained in a first position relative to the second audio component when a shear force is applied to the first or the second audio component in a direction perpendicular to the first direction.

In another embodiment, the present invention is a securing mechanism for attaching a first audio component of an audio system to a second audio component of the audio system. The securing mechanism comprises a first mechanical component disposed on a surface of the first audio component and a second mechanical component disposed on a surface of the second audio component. The first mechanical component is configured to cooperatively engage the second mechanical component such that the surface of the first audio component is maintained in a position that is substantially parallel to the surface of the second audio component. The first mechanical component is also configured to cooperative engage the second mechanical component such that the surface of the first audio component is prevented from being laterally displaced relative to the surface of the second audio component.

In another embodiment, the present invention is an audio system comprising a first enclosure for housing a first audio component and a second enclosure for housing a second audio component. The first enclosure includes a surface having a plurality of first structures, the first structures comprising one selected from a group consisting of a plurality of protrusions and a plurality of receptacles. The second enclosure includes a surface having a plurality of second structures, the second structures comprising the other one from the group consisting of the plurality of protrusions and the plurality of receptacles. The protrusions are configured to be inserted into the receptacles along a first direction such that the first enclosure is maintained in a first position relative to the second enclosure in the presence of a shear force that is applied in a direction that is perpendicular to the first direction.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
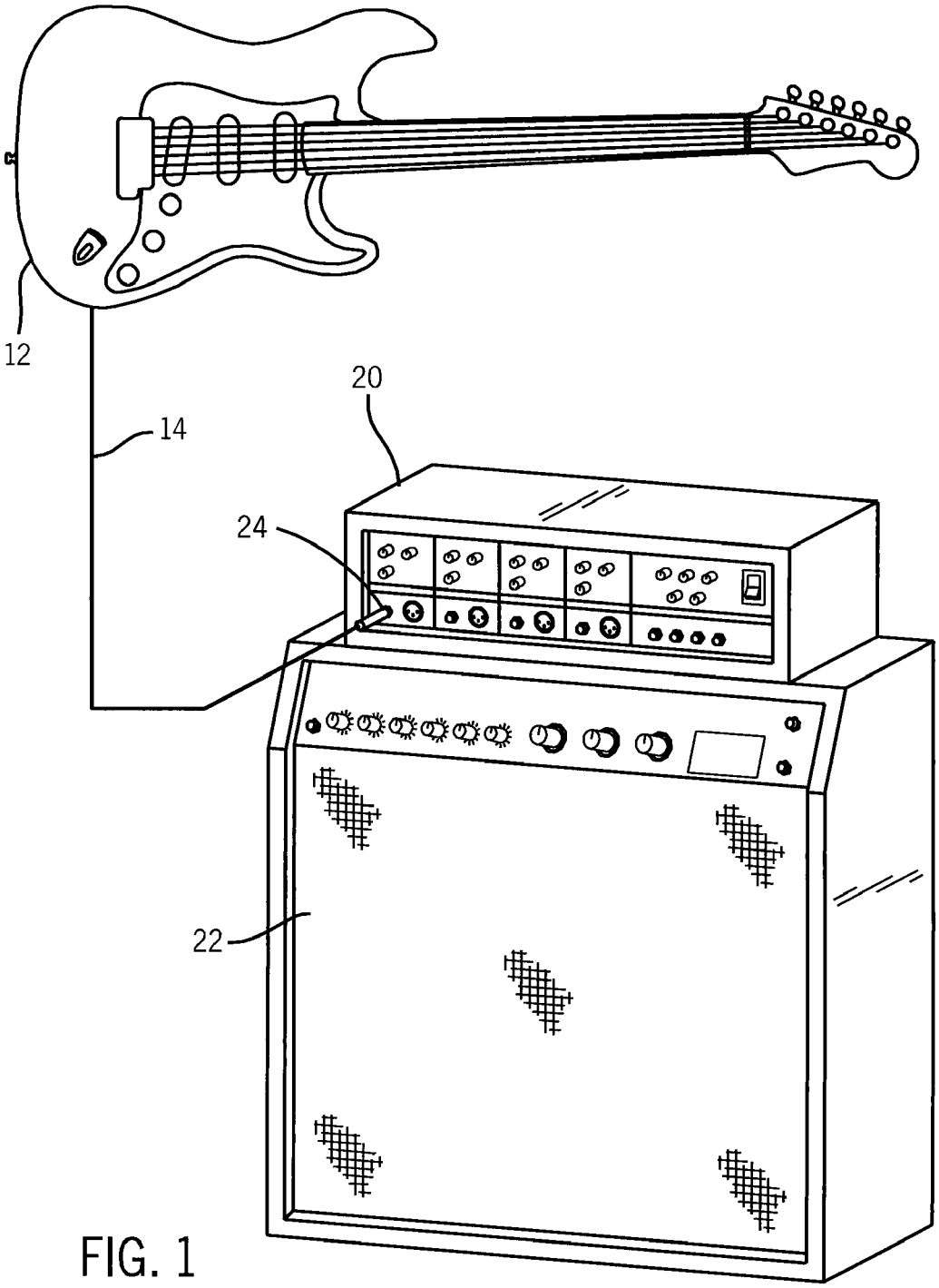
FIG. 1 illustrates a guitar connected to an audio sound system.

Referring to FIG. 1, a musical instrument such as electric guitar 12 is shown with an audio output cable 14. In other embodiments, the musical instrument may be an electric bass guitar, violin, drums, electric keyboard, audio microphone, or other instrument generating electric signals representative of sound content. Guitar 12 generates an electric signal representative of the produced sounds, which is sent to audio amplifier 20 for signal conditioning and power amplification. The audio output of amplifier 20 is electrically connected to speaker system 22, i.e., audio cable 14 plugs into audio input jack 24 on the front panel of audio amplifier 20. The signal conditioning may include amplification, equalization, filtering, special effects, and other signal processing functions. The power amplification increases the power level and signal strength of the audio signal to drive speaker 22 and reproduce the original sound from the musical instrument.

Figure 2:
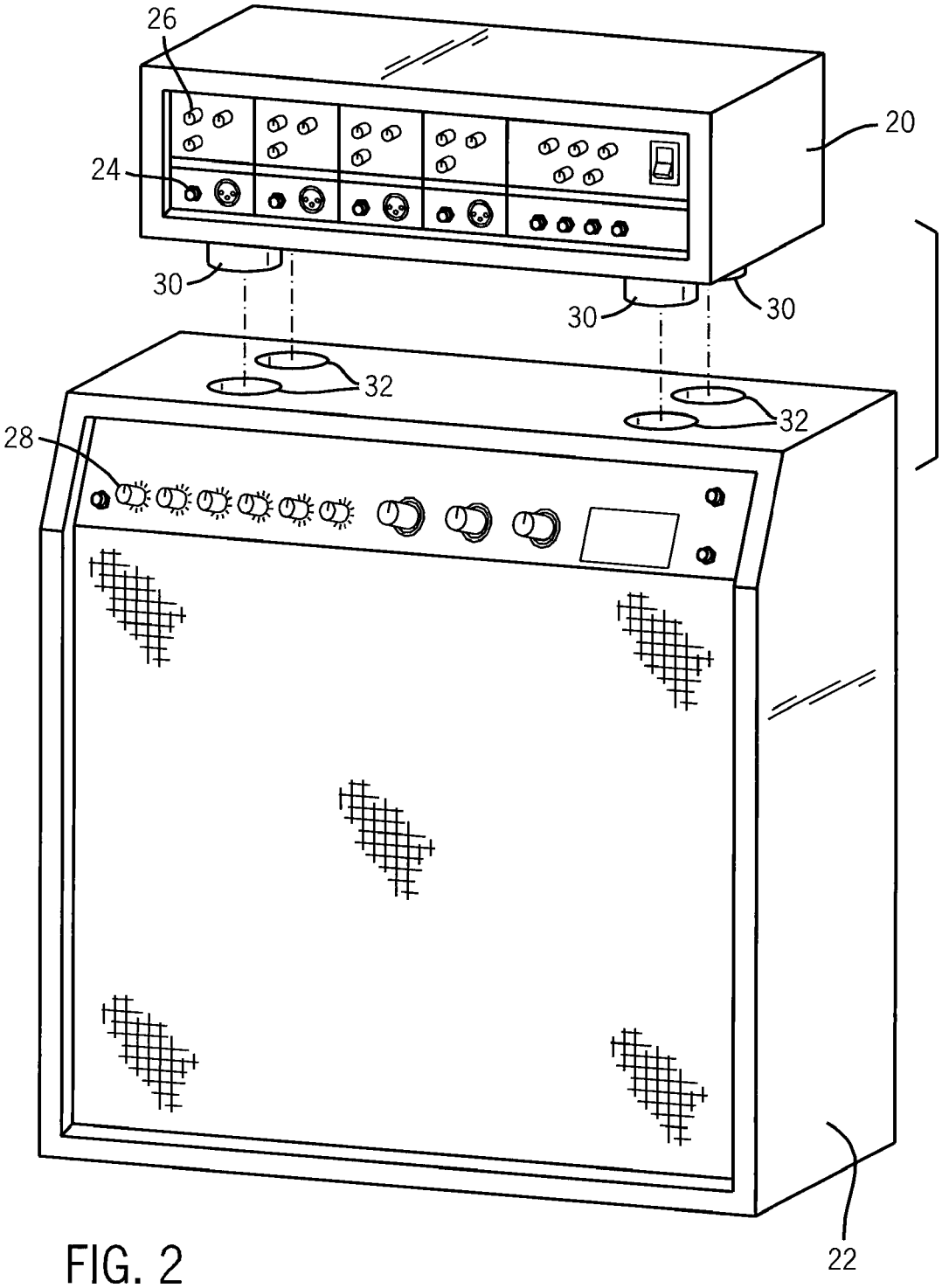
FIG. 2 illustrates an audio amplifier aligned with the speaker system and secured with a magnetic coupler.

Turning to FIG. 2, audio amplifier 20 is shown as a separate component or unit from speaker 22. Audio amplifier 20 and speaker 22 are each housed in their respective enclosures. Audio amplifier 20 has a control panel 26 for selecting features such as amplification, equalization, balance, and other tonal qualities and properties of the audio signal. Speaker 22 also may have a control panel 28 for selecting speaker control functions. Audio amplifier 20 may output 250 watts of power to speaker 22.

The enclosure of audio amplifier 20 has a substantially flat bottom surface, aside from feet 30. Likewise, the enclosure of speaker 22 has a substantially flat top surface, aside from receptacles 32. The bottom surface of audio amplifier 20 has four circular feet 30. In one embodiment, each foot 30 is about 1.0-2.0 inches in diameter and 0.75 inches in height. The top surface of speaker 22 has four receptacles 32 slightly larger than feet 30. The feet 30 on the bottom surface of audio amplifier 20 are designed to mate with receptacles 32 on the top surface of speaker 22. As feet 30 are inserted into receptacles 32, the flat bottom surface of audio amplifier 20 comes flush in contact with, or in close proximity to, the flat top surface of speaker 22.

Figure 3:
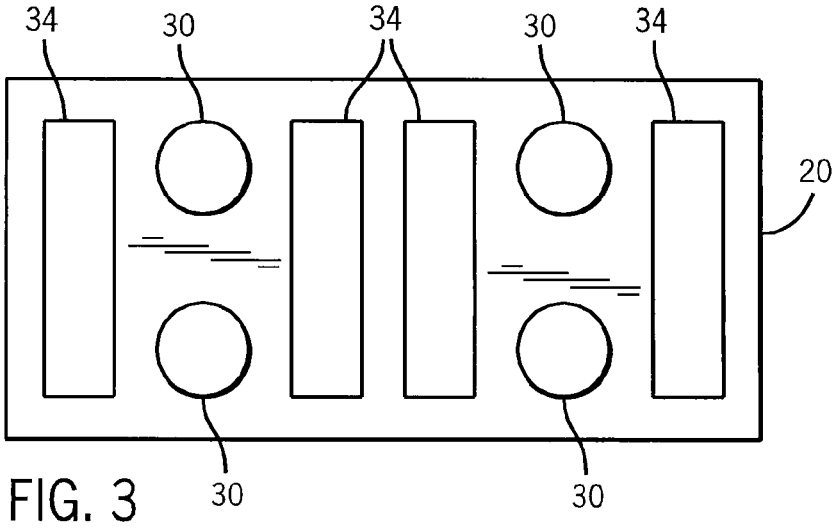
FIG. 3 illustrates a bottom view of the audio amplifier with feet and metallic strips.
Figure 4:
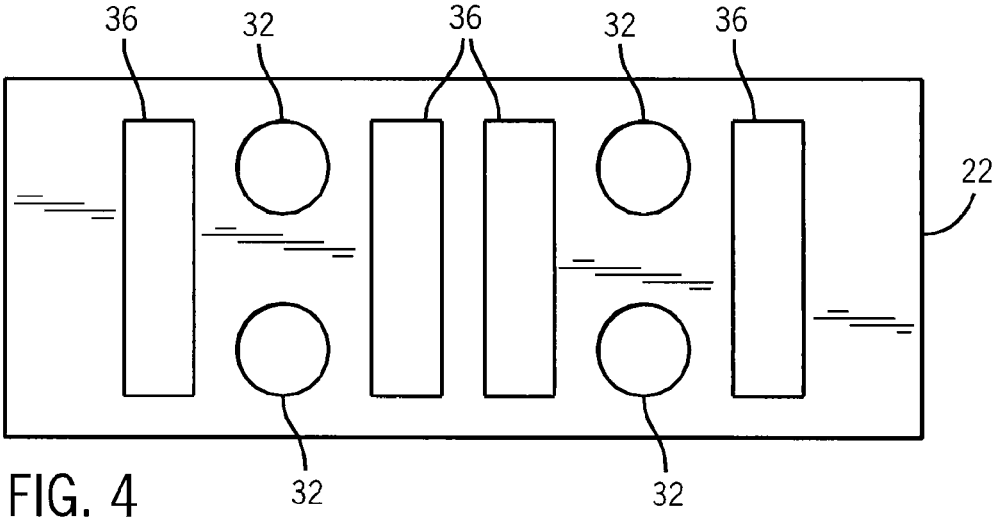
FIG. 4 illustrates a top view of the speaker system with receptacles and metallic strips.

FIG. 3 illustrates the bottom surface of audio amplifier 20. The feet 30 are located in proximity to, or relatively spaced with respect to, the four corners of the bottom surface. FIG. 4 illustrates the top surface of speaker 22. The receptacles 32 are spaced in geometrically the same position as feet 30 so that the center of mass of audio amplifier 20 is substantially over the center of speaker 22. As feet 30 are inserted into receptacles 32, audio amplifier 20 is properly positioned on the top of speaker 22 for optimal stability and balance.

The bottom surface of audio amplifier 20 is secured to the top surface of speaker 22 by way of a magnetic coupling. In one embodiment, feet 30 contain magnets, or are magnetically charged, with a first polarity, e.g., positive polarity. In a similar manner, receptacles 32 are neutral metal or magnetically charged with a second polarity opposite to the first polarity, e.g., negative polarity. Feet 30 and receptacles 32 may respectively be given the opposite magnetic charges from that described above. By bringing feet 30 in close proximity of and inserting into receptacles 32, the magnetic force between the opposing attractive polarities causes the audio amplifier 20 to be secured attached or held to speaker 22.

The securing assembly between audio amplifier 20 and speaker 22 is embodied as a magnetically coupled feet and receptacles assembly. The feet portion of the assembly may be provided on audio amplifier 20 or the feet portion may be on speaker 22. Likewise, the receptacle portion of the assembly may be provided on audio amplifier 20 or the receptacle portion may be on speaker 22. In any case, it is the magnetic force between feet 30 and receptacles 32 that securely holds audio amplifier 20 to speaker 22.

In another embodiment, metallic strips are disposed along the length, width or depth of the bottom surface of audio amplifier 20 and likewise along the top surface of speaker 22. In FIG. 3, metallic strips 34 are disposed across the depth of the bottom surface of audio amplifier 20, and metallic strips 36 are disposed across the depth of the top surface of speaker 22. Metallic strips 34 and/or metallic strips 36 can be magnetized with attractive polarities. In this case, the magnetic strips 34 and 36 hold audio amplifier 20 to speaker 22, while feet 30 and receptacles 32 operate as alignment guides and provide shear strength to the union between the components. The magnetic coupling may be external or internal to the enclosures.

In some audio sound systems, the speaker system may be stacked on top of the audio amplifier, in which case a bottom surface of the speaker system is secured to a top surface of the amplifier by way of the magnetic coupling.

Figure 5:
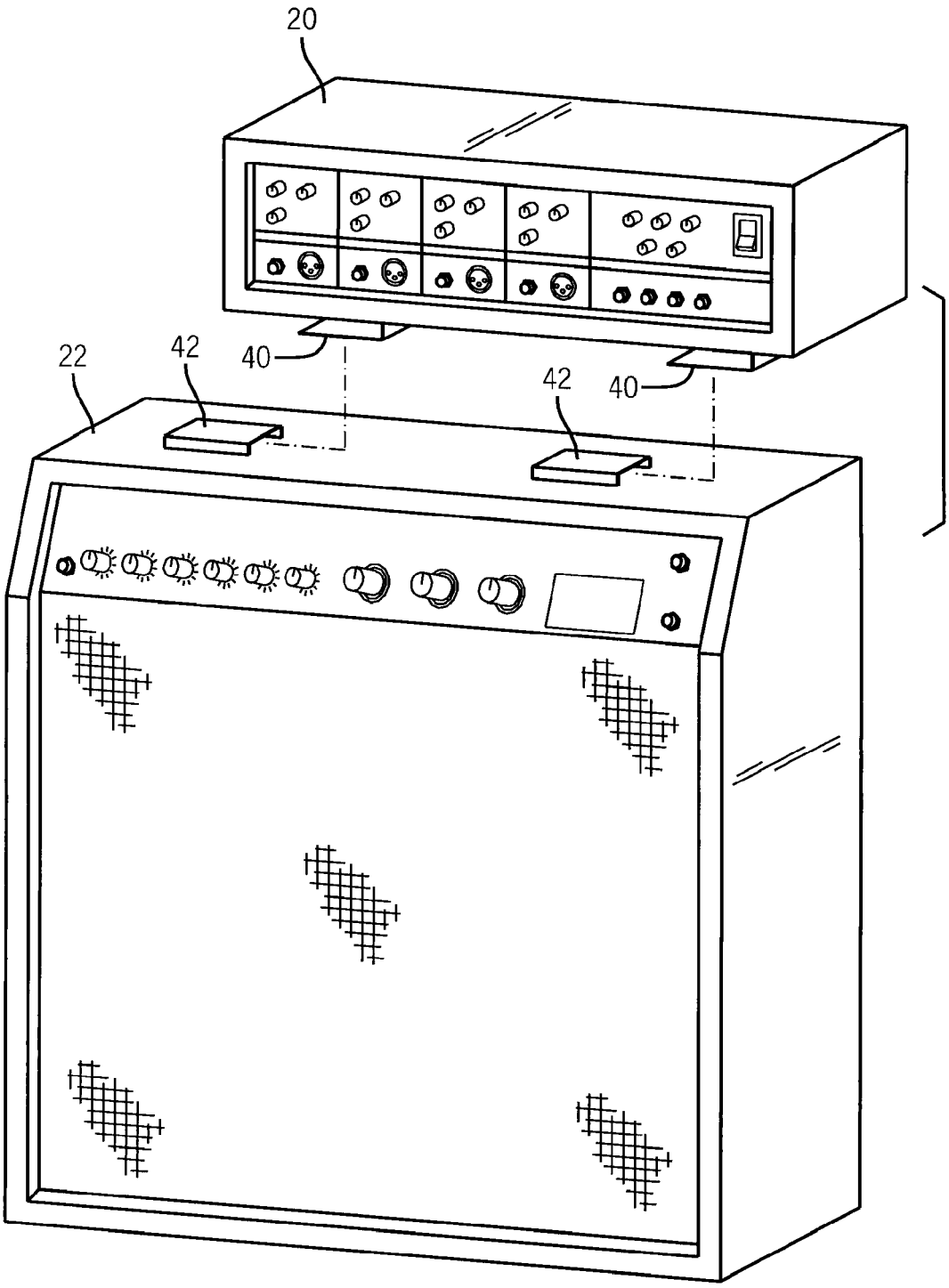
FIG. 5 illustrates the audio amplifier aligned with the speaker system for securing with tongue and slot assembly.
Figure 6:
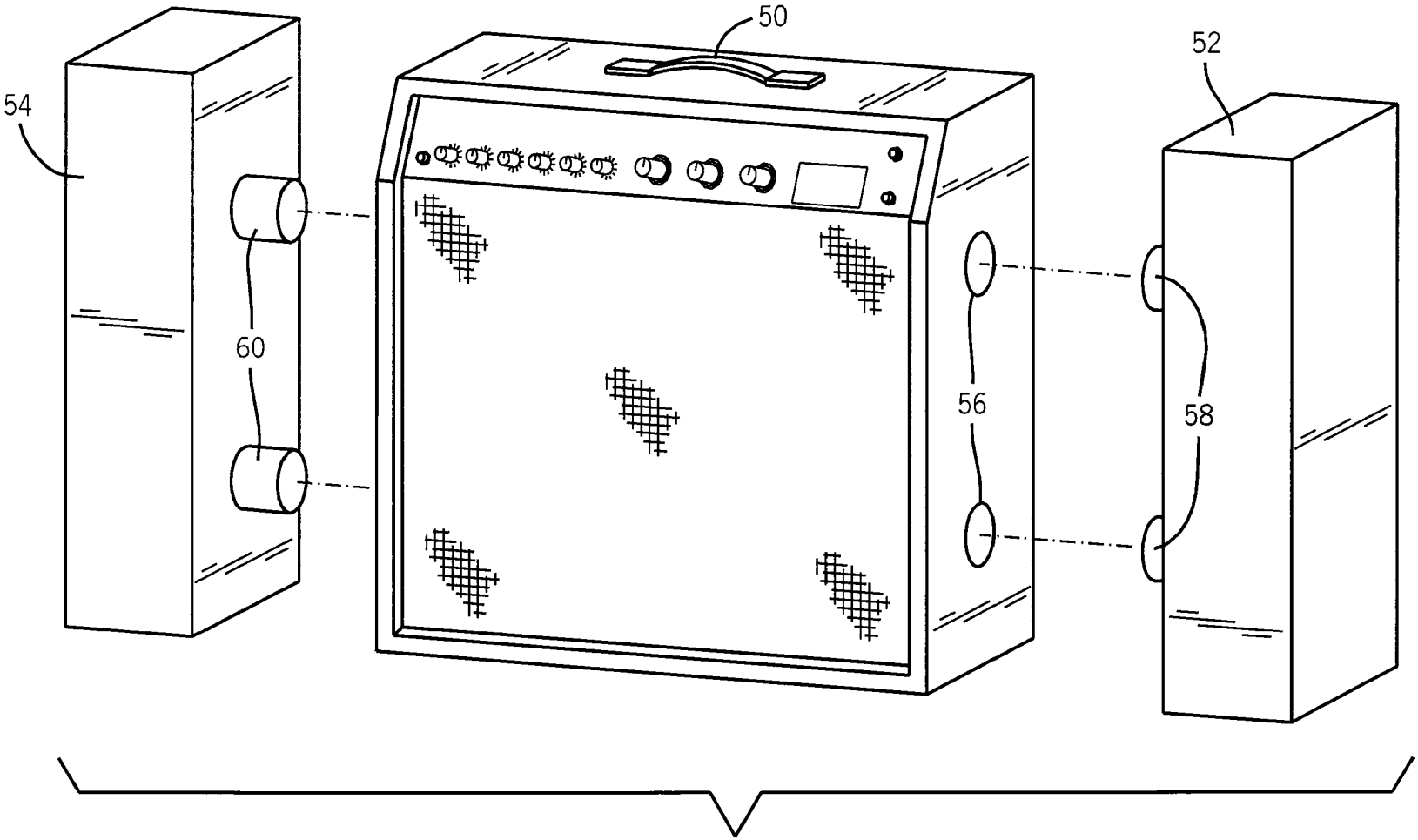
FIG. 6 illustrates speakers secured to the sides of the audio amplifier with magnetic couplers.

The magnetic coupling between audio amplifier 20 and speaker 22 is one embodiment of the securing mechanism or assembly between the components. Another securing mechanism is shown in FIG. 5. Brackets or tongues 40 are formed in or coupled to the bottom surface of audio amplifier 20. Slots or grooves 42 are provided on the top surface of speaker 22. The brackets and slots may be exchanged between the opposite surfaces. To mount the components, the bottom surface of audio amplifier 20 is placed to the side and in vertical proximity to the top surface of speaker 22. The end of brackets 40 are aligned to the opening of slots 42. Brackets 40 slide into slots 42 in a horizontal direction until the brackets are completely contained within the slots. The center of mass of audio amplifier 20 should then be centered over the top surface of speaker 22. The brackets 40 contained in the slots 42 keep audio amplifier 20 securely attached to speaker 22. As an additional securing measure, a clip or latch on one end of audio amplifier 20 keeps brackets 40 from slipping out of slots 42.

Another example of the securing assembly involves the use of Velcro disposed on the joining surfaces between audio amplifier 20 and speaker 22. The Velcro can be used in conjunction with the feet and receptacle alignment assembly. The Velcro provides retaining strength against vertical and shear forces asserted on the audio amplifier.

In another embodiment, audio amplifier 50 is adapted to receive side-mounted speakers 52 and 54. Audio amplifier 50 has receptacles 56. Speaker 52 has feet 58. Feet 58 and receptacles 56 are magnetically charged such that when speaker 52 is brought into proximity to audio amplifier 50, the feet 58 are inserted into receptacles 56 and the components are securely held together by the attractive magnetic forces. Likewise, speaker 54 has feet 60 which insert into receptacles like 56 on the opposite side of audio amplifier 50. As speaker 54 is brought into proximity to audio amplifier 50, the feet 60 are inserted into the receptacles and the components are securely held together by the attractive magnetic forces.

Figure 7:
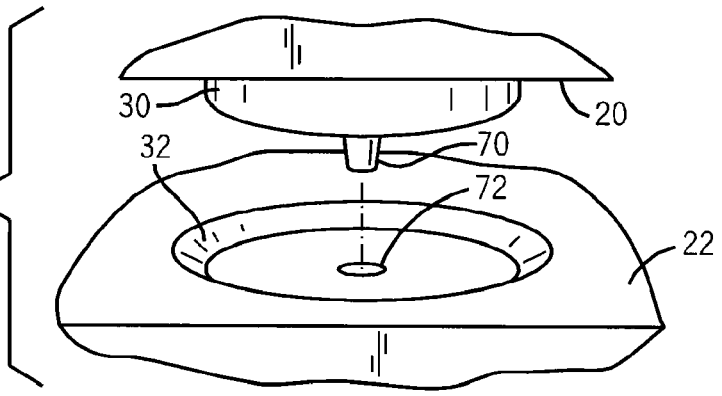
FIG. 7 illustrates a foot and receptacle assembly with electrical connectors.

The feet and receptacle assembly provides a precise alignment between audio amplifier 20 and speaker 22. Accordingly, an electrical connection can be made between each foot 30 and corresponding receptacle 32. As shown in FIG. 7, as foot 30 is inserted into receptacle 32, male electrical connection 70 is inserted into female electrical connection 72, which makes electrical contact therebetween. With four separate foot/receptacle pairs, at least four electrical connections can be made between audio amplifier 20 and speaker 22. The electrical conductor within electrical connection 70 is electrically isolated from the remainder of foot 30. Likewise, the electrical conductor within electrical connection 72 is electrically isolated from the remainder of receptacle 32. The electrical conductors within electrical connections 70 and 72 route the audio signal from audio amplifier 20 to speaker 22. Since the physical contact between electrical connection 70 and electrical connection 72 is blind as foot 30 is inserted into receptacle 32, and to aid in mating the electrical connections, each electrical connection pair are made conical in shape as mirror images of one another. Otherwise, insertion guides are provided to align electrical connection 70 with electrical connection 72.

The electrical connections within the foot/receptacle assemblies allow audio signals from audio amplifier 20 to be routed to speaker 22, which is an improvement over the external electrical cable connections between audio amplifier 20 and speaker 22. With the electrical connections within the foot/receptacle assemblies, no external electrical cable connections need to be made to electrically connect audio amplifier 20 to speaker 22. The necessary electrical connections between the components are automatically made through the foot/receptacle assemblies when the amplifier is stacked on top of and magnetically coupled to the speaker.

While one or more embodiments of the present invention have been illustrated in detail, the skilled artisan will appreciate that modifications and adaptations to those embodiments may be made without departing from the scope of the present invention as set forth in the following claims.

What is claimed is:

1. An audio system, comprising:

a first audio component including a plurality of feet; and a second audio component including a plurality of receptacles configured to magnetically couple to the feet of the first audio component and to maintain a position of the first audio component relative to the second audio component by nature of the feet being disposed into the receptacles.

2. The audio system of claim 1, wherein a first receptacle from among the plurality of receptacles includes a magnetic material.

3. The audio system of claim 1, wherein a center of mass of the first audio component is substantially aligned with a center of the second audio component when the feet and receptacles are mated.

4. The audio system of claim 1, wherein the first audio component comprises one selected from a group consisting of an audio amplifier and a speaker, and the second audio component comprises the other one of the group consisting of the audio amplifier and the speaker.

5. The audio system of claim 1, wherein a first foot from among the plurality of feet comprises a first electrical connector and a first receptacle from among the plurality of receptacles comprises a second electrical connector, the first electrical connector configured to electrically couple to the second electrical connector.

6. The audio system of claim 1, further comprising:

a first magnetic strip disposed on a surface of the first audio component; and a second magnetic strip disposed on a surface of the second audio component, the second magnetic strip including a polarity opposite a polarity of the first magnetic strip.

7. An audio system, comprising:

a first audio component including a protrusion;

a second audio component including a receptacle to maintain a position of the first audio component relative to the second audio component by nature of the protrusion being disposed into the receptacle; and a magnetic coupling between the first and second audio components, the magnetic coupling configured to maintain the first audio component in the position relative to the second audio component.

8. The audio system of claim 7, wherein the magnetic coupling comprises a first magnetic material attached to the first audio component.

9. The audio system of claim 8, wherein the magnetic coupling comprises a second magnetic material attached to the second audio component, a polarity of the second magnetic material opposite a polarity of the first magnetic material.

10. The audio system of claim 9, wherein the protrusion comprises the first magnetic material, and wherein the receptacle comprises the second magnetic material.

11. The audio system of claim 9, wherein the first magnetic material is disposed on a surface of the first audio component, and wherein the second magnetic material is disposed on a surface of the second audio component.

12. An audio system, comprising:

a first audio component including a first mechanical component;

a second audio component including a second mechanical component configured to cooperatively engage the first mechanical component to maintain a position of the first audio component from relative to the second audio component;

a first magnetic component disposed on a surface of the first audio component; and a second magnetic component disposed on the surface of the second audio component, wherein the first magnetic component is integrated with the first mechanical component, and the second magnetic component is integrated with the second mechanical component.

13. The audio system of claim 12, wherein the first mechanical component comprises a protrusion, and wherein the second mechanical component comprises a receptacle.

14. The audio system of claim 12, wherein the first mechanical component comprises a bracket and wherein the second mechanical component comprises a slot.

15. The audio system of claim 12, wherein the first and second magnetic components comprise magnetic strips.

16. An audio system, comprising:

a first audio component including a receptacle;

a second audio component including a protrusion configured to be inserted into the receptacle to maintain a position of the second audio component relative to the first audio component; and a magnetic coupling between the first audio component and the second audio component.

17. The audio system of claim 16, wherein the receptacle comprises a first electrical connection and wherein the protrusion comprises a second electrical connection configured to couple to the first electrical connection.

18. The audio system of claim 16, wherein the magnetic coupling comprises a first magnetic strip disposed on a surface of the first audio component.

19. The audio system of claim 18, wherein the magnetic coupling further comprises a second magnetic strip disposed on a surface of the second audio component.

* * * * *